US006767246B2

(12) United States Patent
Quinn et al.

(10) Patent No.: US 6,767,246 B2
(45) Date of Patent: Jul. 27, 2004

(54) SNAP-IN RELAY SOCKET SYSTEM

(75) Inventors: Ian Quinn, Medford, MA (US); Marc Lefebvre, Medford, MA (US)

(73) Assignee: Amphenol Corporation, Wallingford, CT (US)

( * ) Notice: Subject to any disclaimer, the term of this patent is extended or adjusted under 35 U.S.C. 154(b) by 43 days.

(21) Appl. No.: 10/061,984

(22) Filed: Feb. 1, 2002

(65) Prior Publication Data

US 2002/0142643 A1 Oct. 3, 2002

Related U.S. Application Data

(60) Provisional application No. 60/265,566, filed on Feb. 1, 2001.

(51) Int. Cl.[7] ..... H01R 13/74
(52) U.S. Cl. ..... 439/555; 439/557
(58) Field of Search ..... 439/555, 577

(56) References Cited

U.S. PATENT DOCUMENTS

| | | | |
|---|---|---|---|
| 3,244,941 | A | 4/1966 | Maynard et al. |
| 4,634,203 | A | 1/1987 | Noyes |
| 4,822,294 | A | 4/1989 | McClearn |
| 4,824,389 | A | 4/1989 | Doyle et al. |
| 5,035,647 | A | 7/1991 | Schafer |
| 5,074,801 | A | 12/1991 | Siemon |
| 5,199,900 | A | 4/1993 | Hayes, Sr. |
| 5,238,426 | A | 8/1993 | Arnett |
| 5,275,575 | A | 1/1994 | Cahaly et al. |
| 5,277,623 | A | 1/1994 | Colleran et al. |
| 5,302,140 | A | 4/1994 | Arnett |
| 5,314,345 | A | 5/1994 | Cahaly et al. |
| 5,372,523 | A | 12/1994 | Sakatani et al. |
| 5,525,074 | A | 6/1996 | Tsuji et al. |
| 5,578,870 | A | 11/1996 | Farnsworth et al. |
| 5,613,876 | A | 3/1997 | Sakatani et al. |
| 5,766,035 | A | 6/1998 | Alibert |
| 6,089,909 | A | 7/2000 | Tokuwa |
| 6,123,579 | A | 9/2000 | Ping |

FOREIGN PATENT DOCUMENTS

| | | |
|---|---|---|
| FR | 2153752 | 5/1973 |
| GB | 2310550 | 8/1997 |

*Primary Examiner*—Neil Abrams
(74) *Attorney, Agent, or Firm*—Blank Rome LLP

(57) ABSTRACT

A relay socket is attachable to a cutout in a panel. The relay socket includes a base, at least one rocker beam or heel element at one side of said base, and at least one active snap element at the opposite side of said base. The elements are constructed and arranged so that the socket may be inserted into place by engaging the rocker beam element on one side of a cutout in a panel and pivoting the active snap element toward the opposite side of the cutout so that it engages the opposite side of the cutout and moves inwardly and is inserted into the cutout in which position it moves outwardly to engage the opposite side of the cutout. In this way the elements cooperatively hold the socket onto the panel. There is also an assembly which includes the relay socket. This assembly includes the panel with a cutout into which the relay socket is to be attached as well as the relay itself on the other side of the panel from the relay. The presence of the relay and snap elements prevent disengagement of the socket from the panel. This provides a connection arrangement which has less parts and is easier and faster to assemble.

4 Claims, 8 Drawing Sheets

SNAP-IN RELAY SOCKET SYSTEM

REFERENCE TO RELATED APPLICATIONS

The present application is based on and claims the priority of provisional application Ser. No. 60/265,566, filed Feb. 1, 2001.

FIELD OF THE INVENTION

The present invention relates to sockets for relays, and more particularly, to snap mount relay sockets. It relates to an avionics connector that allows for discrete wires to be electrically connected to mating relays.

BACKGROUND OF THE INVENTION

Avionics relay sockets designed to connect discrete wires to relays must perform the following basic functions:

Provide a secure mechanical connection between the relay, relay socket, and mounting panel;

Provide a secure mechanical and electrical connection between the discrete wire and the relay, and Provide environmental seal for the discrete wires connected to the relay.

Traditionally, a bottom-mount four pole relay socket is secured to the mounting panel using eighteen (18) loose hardware components. The sequence for assembly is as follows:

Secure (3) washers and (3) 4–40 self-locking nuts to the relay studs;

Insert the socket assembly into the mounting panel cutout and secure using (3) washers and (3) 8–32 self-locking nuts; and Attach relay and secure to the relay socket using (3) washers and (3) 4–40 self-locking nuts.

One type of prior art device is disclosed in U.S. Pat. No. 5,766,035, issued Jun. 16, 1998. This patent has a plug base for an electric relay. It is placed into an opening in a panel and has resilient lugs at each side which hold the base in place in the panel.

SUMMARY OF THE PRESENT INVENTION

It is a main object of the present invention to provide a relay socket that reduces the labor and hardware necessary for proper assembly of a bottom mount relay system.

It is another object of the present invention to provide for simple insertion of a relay socket which is held in place so that a relay may be securely attached thereto.

The present invention accomplishes this and other objects by incorporating at least one rocker beam or heel on one side of the socket and at least one active snap feature or toe on the other side. The relay socket is temporarily secured to a panel by using the rocker beam to hook into the panel cutout creating a small pre-load before the active snap feature is engaged. The sequence to assemble the relay system using this invention is to attach the socket to the panel by hooking the heel side to the panel, rock the socket into place, and engage the toe side of the socket.

Other objects, features and advantages will be apparent from the following detailed description of preferred embodiments thereof taken in conjunction with the accompanying drawings in which:

BRIEF DESCRIPTION OF THE DRAWINGS

FIG. 5A is a schematic view of a first step in assembly of the socket.

FIG. 5B is a schematic view of a second step in assembly of the socket.

GENERAL DESCRIPTION

The present invention accomplishes this and other objects by incorporating at least one rocker beam or heel on one side of the socket and at least one active snap feature or toe on the other side. The relay socket is temporarily secured to a panel by using the rocker beam to hook into the panel cutout creating a small pre-load before the active snap feature is engaged. The sequence to assemble the relay system using this invention is to attach the socket to the panel by hooking the heel side to the panel, rock the socket into place, and engage the toe side of the socket.

In one configuration when a spacer, washer and bolt are used, the sequence is to then:

Attach the spacer, washer, and screw to the relay; and

Attach the relay to the socket by fastening (3) screws, thereby sandwiching the panel between the spacers on the relay side and the housing of the relay socket on the other side.

It should be noted that once the relay is assembled to the socket as described above, the snaps cannot be disengaged without removing the relay.

The snap-in relay socket incorporates a heel-toe design that allows the socket to be temporarily secured to a mounting panel prior to the final assembly of the relay. The loose hardware required to mount a 4-pole relay, in one configuration, is reduced from eighteen (18) pieces to nine (9). The mounting screws are captive to the relay for ease of assembly.

DETAILED DESCRIPTION OF PREFERRED EMBODIMENTS

Figure 1:
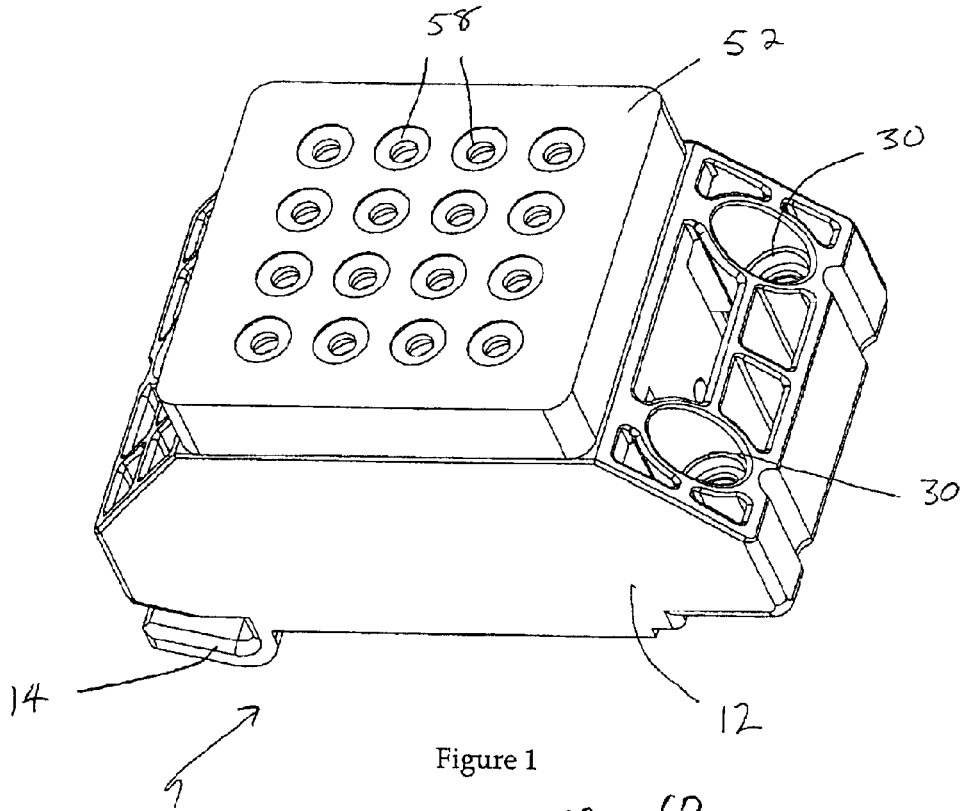
FIG. 1 is an isometric view of the top of the snap mount relay socket of one embodiment of the present invention.
Figure 2:
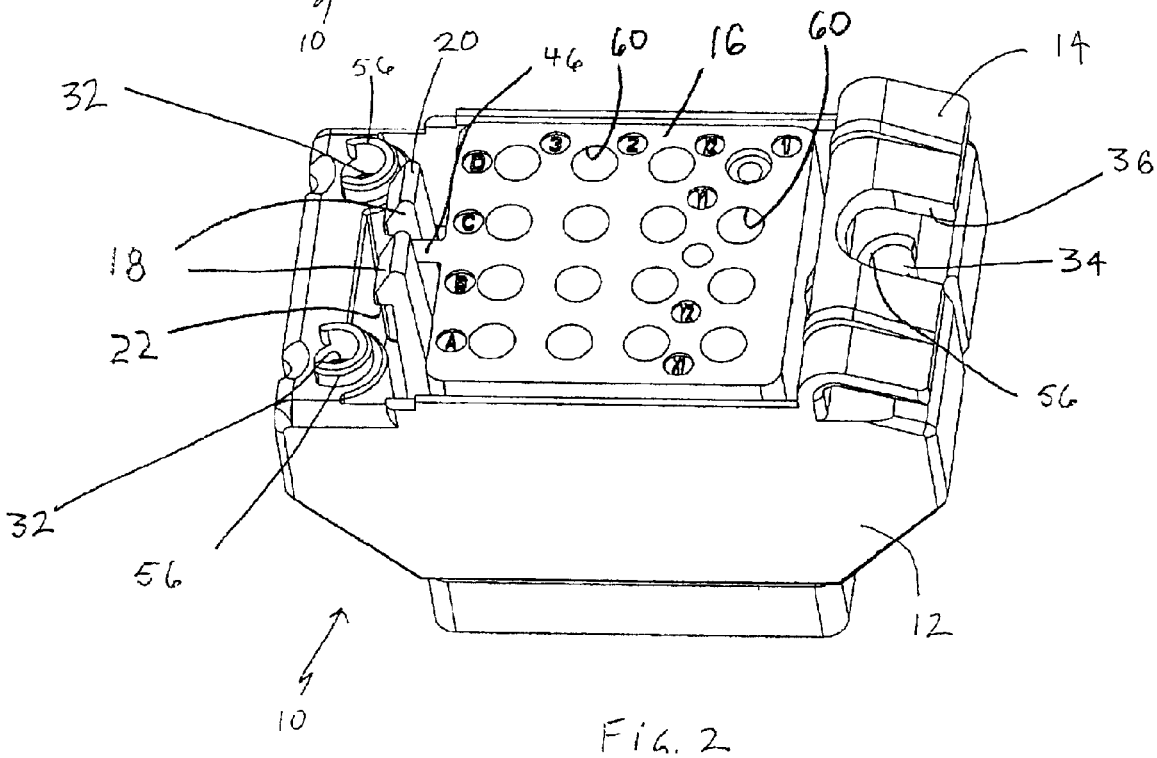
FIG. 2 is an isometric view of the bottom of the snap mount relay socket shown in FIG. 1.

In accordance with the present invention, a snap mount relay socket 10 is shown in FIGS. 1 and 2 which includes a housing 12 provided with a heel 14, which may have some spring characteristics, at one end which is in the form of a hook and toes 18 at the other end of the socket housing, each of which has a tapered nose 20 and a shoulder 22 for a purpose to be described below.

FIG. 1 shows the upper end of the socket 10, which has a grommet 52 with openings 58 for a purpose to be explained. There are mounting or assembly openings 30, and the relay side of assembly openings 30 are visible. The heel 14 is shown on the left side of the socket 10. In FIG. 2 the other ends of openings 30 are shown as assembly openings 32 for connecting the socket 10 and the relay to the mounting panel which will be explained further below.

FIG. 2 shows the lower end of the socket 10 which is mounted against the panel. There is a bottom housing 44 mounted to the housing 12 with openings 60 for relay connections and into which leads on the relay project when the relay is in place.

The other ends of the assembly openings 30 are shown at 32. This is the side of the socket 10 to which wires will be connected to bring signals and power to the relay. For this purpose the openings 58 from the grommet side to the lower housing side have electrical conductors so that the wires mentioned above and the prongs or leads on the relays will be electrically connected when the assembly of the socket and relay is completed.

There is an assembly opening 34 at the heel end of the socket and the heel 14 has a U-shaped cut-out 36 so that the connectors (screws, bolts or the like) may be accessed as described below.

Figures 6A, 6B, 6C, 6D:
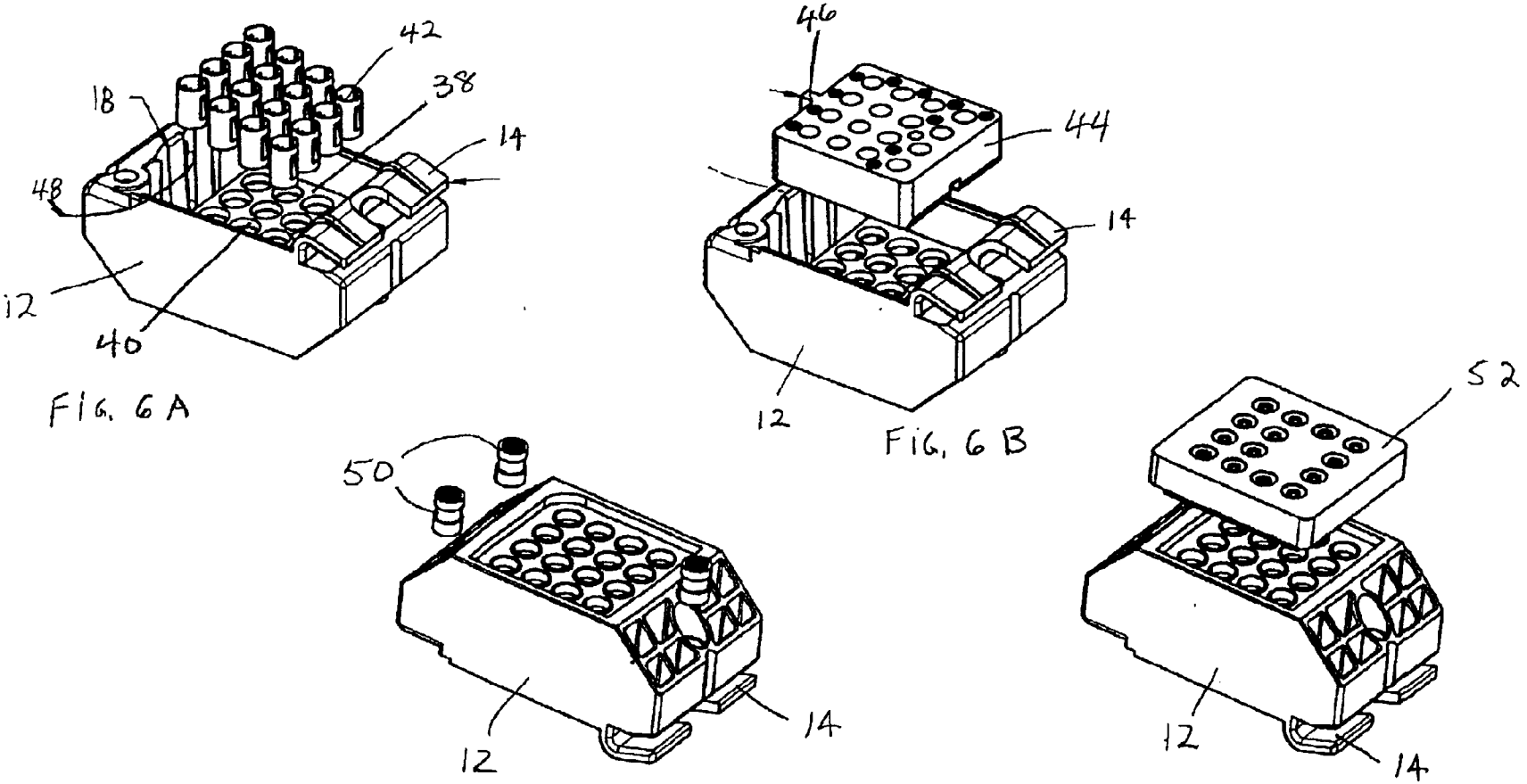
FIGS. 6A–6D show the steps in the assembly of the socket.

The assembly of the socket is shown in FIGS. 6A–D. FIG. 6A shows the housing 12 which can be made of one piece including the web 38 with holes 40. Contact retainers 42 are placed into the housing 12. There is a contact insert or lower housing 44 placed into the housing 12 and welded in place. The housing is of a plastic material. The lower housing 44, which may be welded to the housing 12, has a projection 46 which fits into a groove or a space 48 located between the toes 18 in the housing 12 to provide a polarizing feature so that the arrangement for contacts is properly oriented. Thus, the projection 46 only fits into the space adjacent to the toes so that the contact arrangement will always be correct after assembly. Next, threaded inserts 50 are pressed into the openings 30,32 on the one hand and 34 on the other for use when fastening the assembly, of the socket with the relay, together.

Next, the grommet 52 is bonded to the top of the housing 12 and has openings 58 which match the openings for the contacts for the relay contacts, so that connections can be made to other circuitry. The relay contacts fit into the openings in the bottom of the housing and thereby are attached to the relay contacts. In this manner the socket housing assembly is formed for use later in assembly with a relay.

Figure 5C:
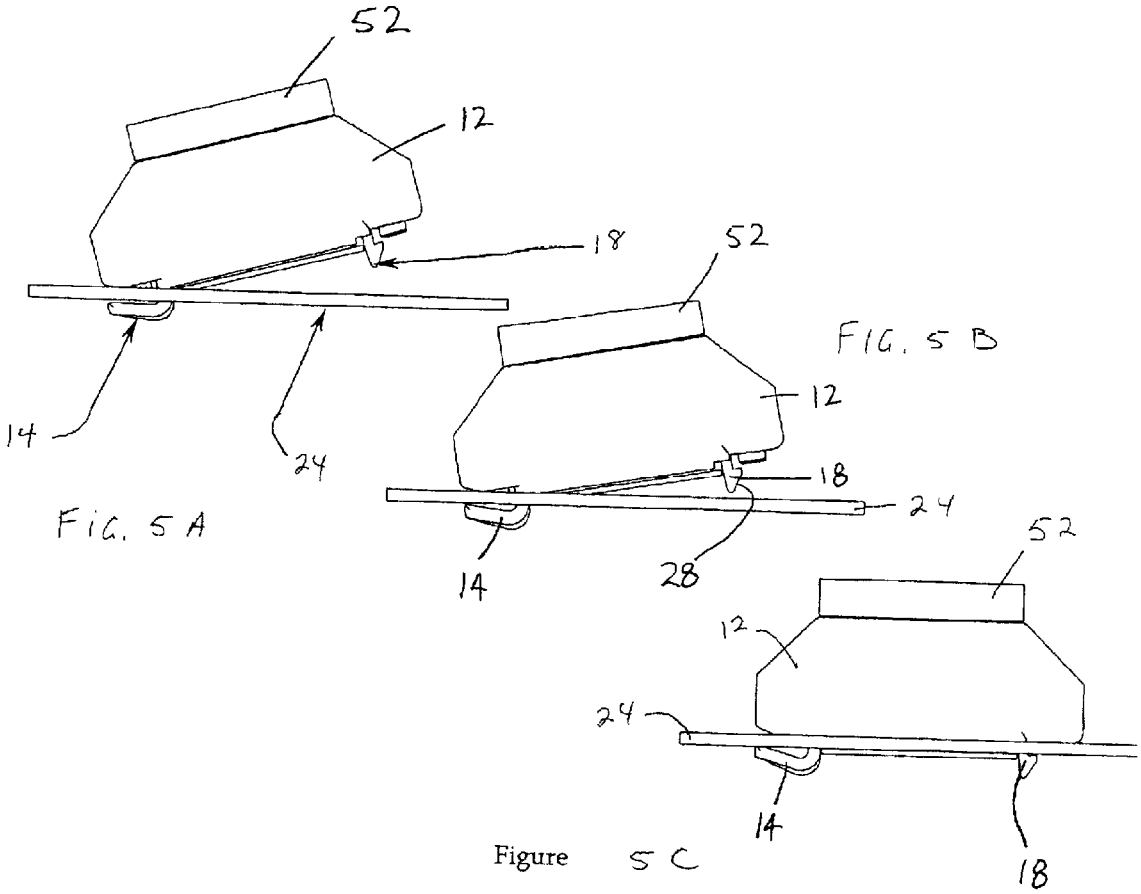
FIG. 5C is a schematic view of a third step in assembly of the socket.
Figure 7:
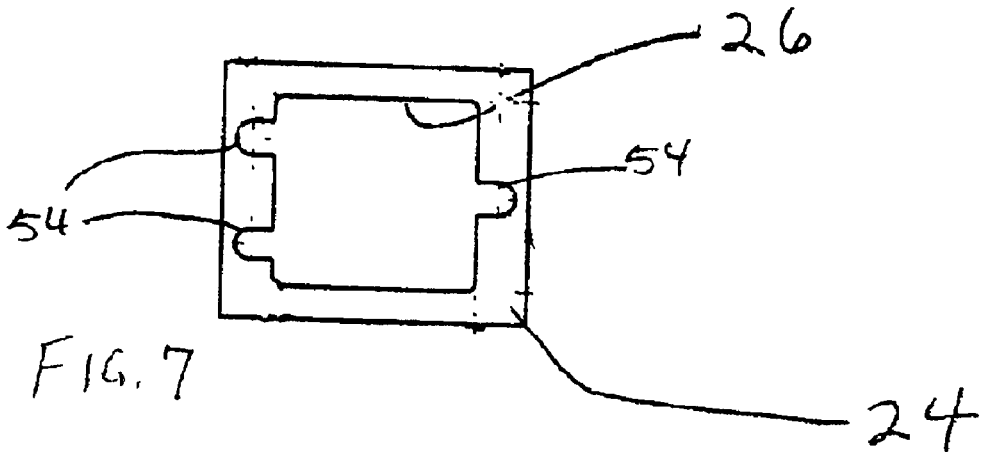
FIG. 7 is a view of a mounting panel with a hole in it for the socket.

When the socket 10 is to be attached to a mounting panel 24 it is attached thereto as shown in sequence in FIGS. 5A, 5B and 5C, which should be viewed together with FIG. 7 in connection with the following description. First the heel 14 is engaged at one end (the right end as shown in FIG. 7) of an opening 26 in the mounting panel 24 as shown in FIG. 5A with the socket tilted so that the toes 18 remain above the panel 24. Then, as shown in FIG. 5B the toes are moved toward the panel by rotating movement of the socket 10 and the socket is pressed downwardly so that the toe surfaces 28 on the tapered noses 20 engage the other end of opening 26 (the right end as shown in FIG. 7) and a cam action takes place such that the toes move inwardly toward the heel so that the toes can move past the edges of opening 26 and when the shoulders 22 of the toes have passed the end of the opening 26 the toes 18 spring outwardly so that the socket is held firmly in place with the shoulders resting against the underside of the mounting panel 24 and the toes are biased outwardly to prevent accidental removal of the socket from the panel. This final position is shown in FIG. 5C.

Figure 10:
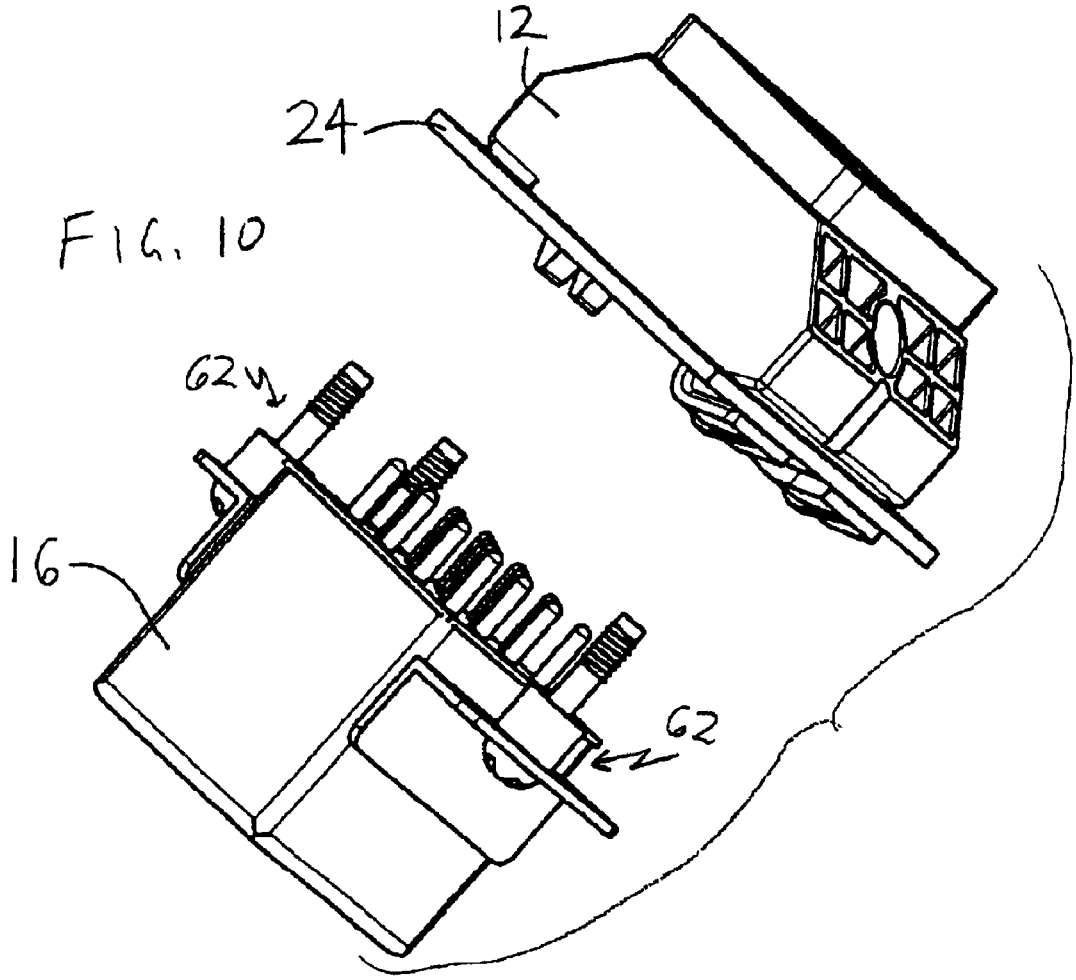
FIG. 10 is an partially exploded isometric view of the socket and mounting board, and a relay.

The opening 26 in the mounting panel 24 is provided with slots 54. As can be seen in FIG. 2 each of the openings 32 and 34 have extended sleeves 56 which project upwardly from the openings. They are partially cut to fit into the slots 54 when the socket is assembled with the mounting panel so that the socket will not be able to slide within opening 26 as might occur if these sleeve-slot combinations were not used. FIG. 10 shows how the relay 16 (with captured hardware) is plugged into the socket-mounting board combination.

It is to be noted that when the relay 16 is installed in place, the toes 18 cannot be biased to disengage the socket, because the relay will not allow such movement. This can be seen from FIG. 12 where the relay extends between the inside surface of the toe 4 and the inside surface of the heel.

Figure 3:
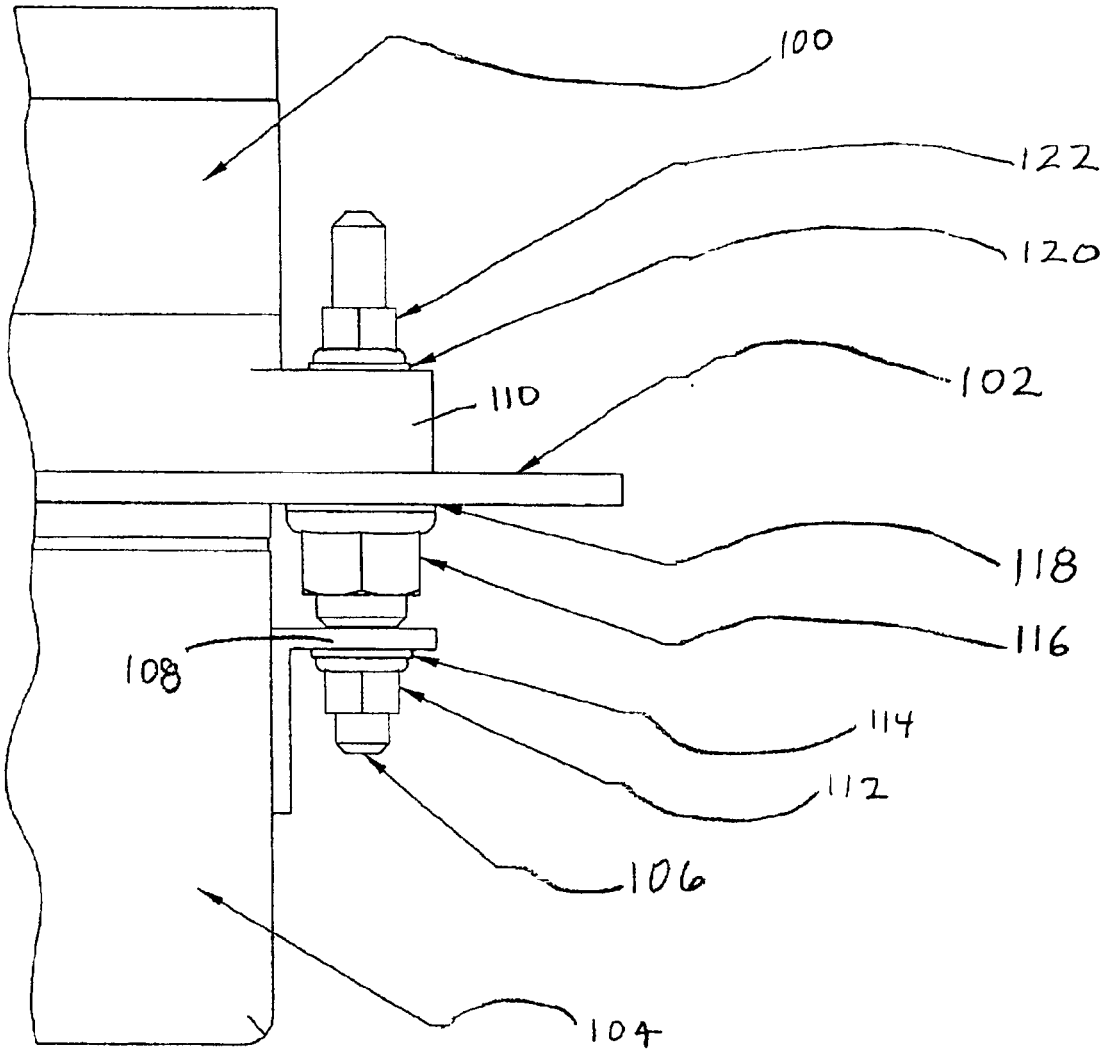
Figure 3 PRIOR ART
FIG. 3 is a partial side elevational view of an assembled relay and socket of the prior art type.

FIG. 3 shows an arrangement of the assembly of a socket 100, mounting panel 102 and relay 104 of a prior art system, in which a stud 106 passes through a flange 108 on the relay 104 and through another flange 110 on the socket, there being a hex nut 112 and a flat washer 114 below flange 108. Above flange 108 there is a hex nut 116 and another flat washer 118. Between flange 110 on the socket which rests against the mounting panel 102 there is a flat washer 120 and a hex nut 122.

Figure 4:
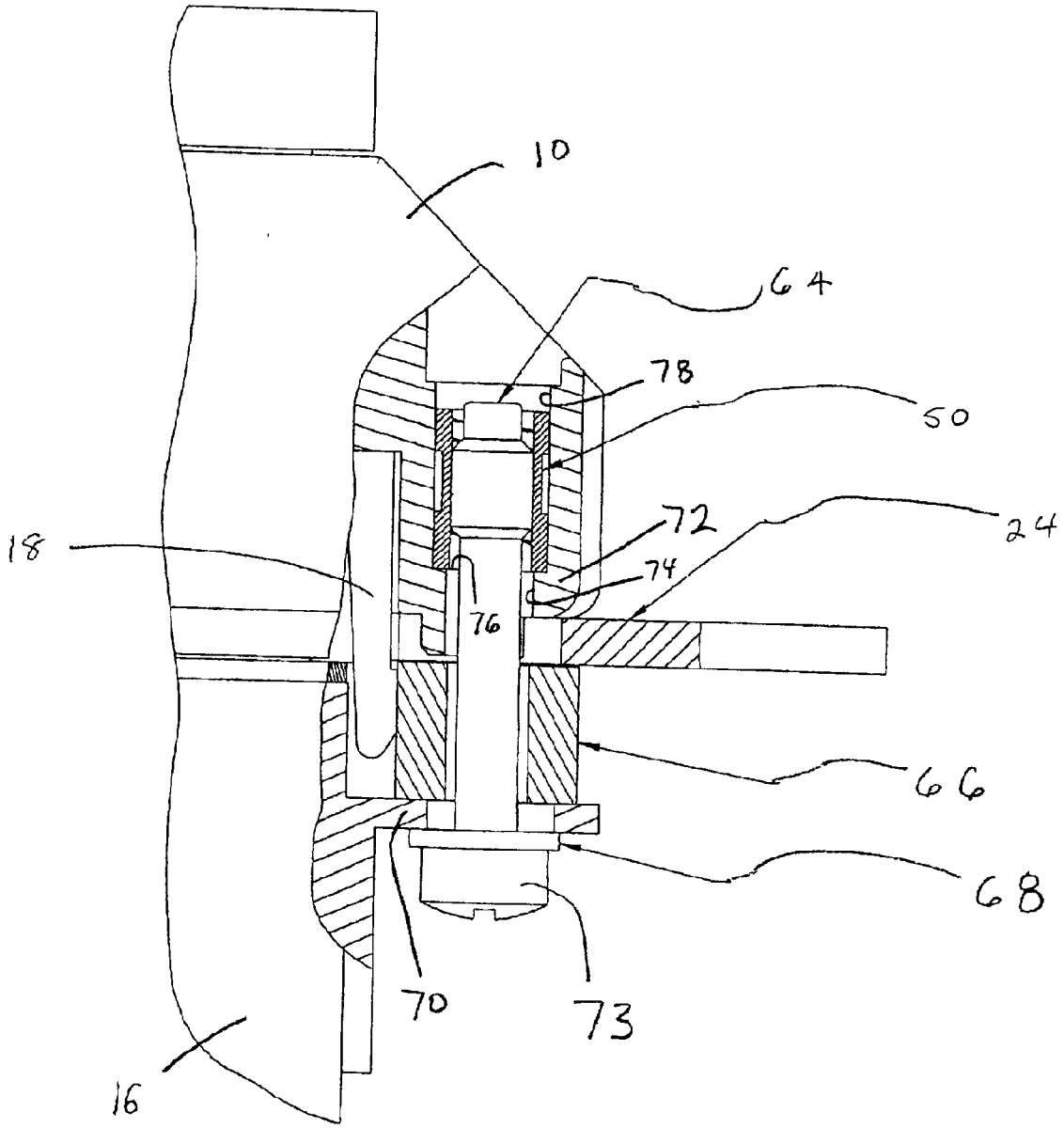
FIG. 4 is a partial side elevational view similar to that of FIG. 3, but of the present invention with parts broken away and shown in section for clarity.

FIG. 4 shows an arrangement of the assembly of the present invention of a socket 10, mounting panel 24 and relay 16, in which a screw or bolt 64 passes through a flange 70 on the relay 16 and through another flange 72 on the socket, there being a split lock washer 68 below flange 70 as well as the head 73 of the bolt 64. Between the flanges 70 of the relay and 72 of the socket, there is a spacer 66.

Above flange 72 which contacts the mounting panel 24, and inside the bore 74, there is a shoulder 76 formed by the bore diameter expending to a larger bore 78. A threaded insert 50 fits within bore 78 and against shoulder 76. As the bolt is turned to tighten the insert 50 onto the bolt 73 this presses the socket flange 72 against the top of the mounting panel 24 and the spacer 66 against the bottom of the mounting panel. Thus, it can be seen that the assembly process is significantly simplified and requires less time than the prior art arrangement.

In this configuration when a spacer 66, washer 68 and bolt 64 are used, the sequence is to then:

Attach the spacer 66, washer 68, and screw to the relay; and

Attach the relay to the socket by fastening (3) screws or bolts, thereby sandwiching the panel 24 between the spacers 66 on the relay side and the housing of the relay socket on the other side.

It should be noted that once the relay is assembled to the socket as described above, the snaps cannot be disengaged without removing the relay.

The slots 54 cut out into the opening 26 in the mounting panel 24 shown in FIG. 7 is for an arrangement using three connectors to hold the assembly together. For a narrower arrangement there would only be one connector and thus one slot on each side of the opening 26. For a wider arrangement there would be two connectors on each side and thus four slots cut into the opening 26 in the mounting panel 24.

Figure 8:
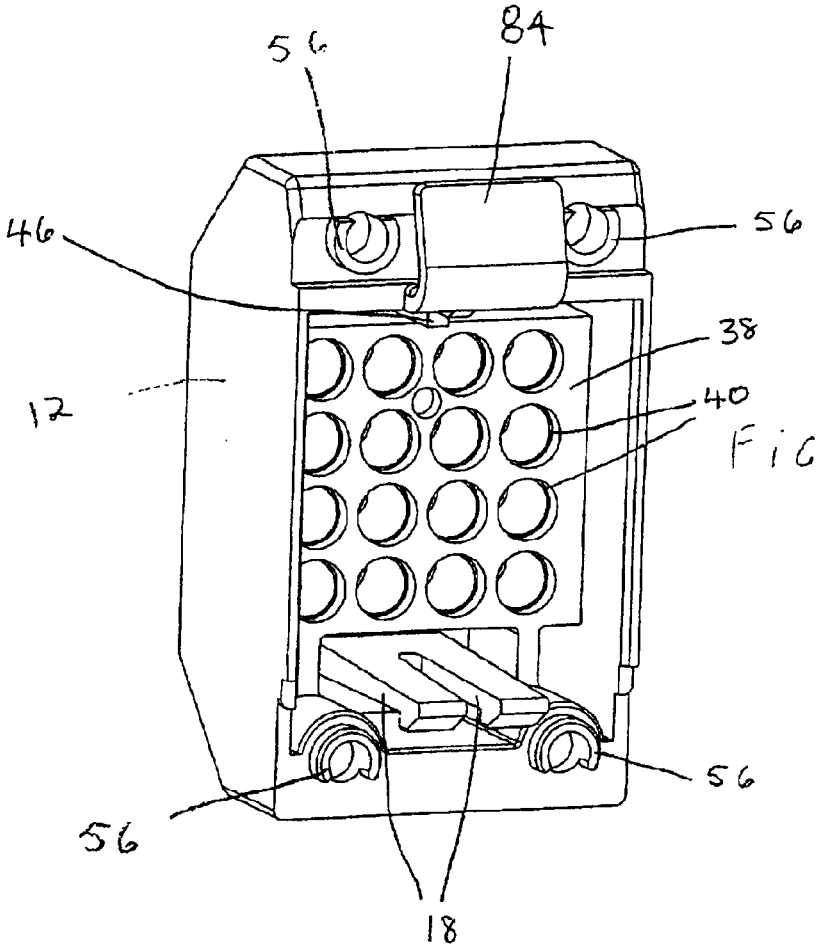
FIG. 8 is an isometric view of the bottom of the snap mount relay socket on another embodiment of the present invention.
Figure 9:
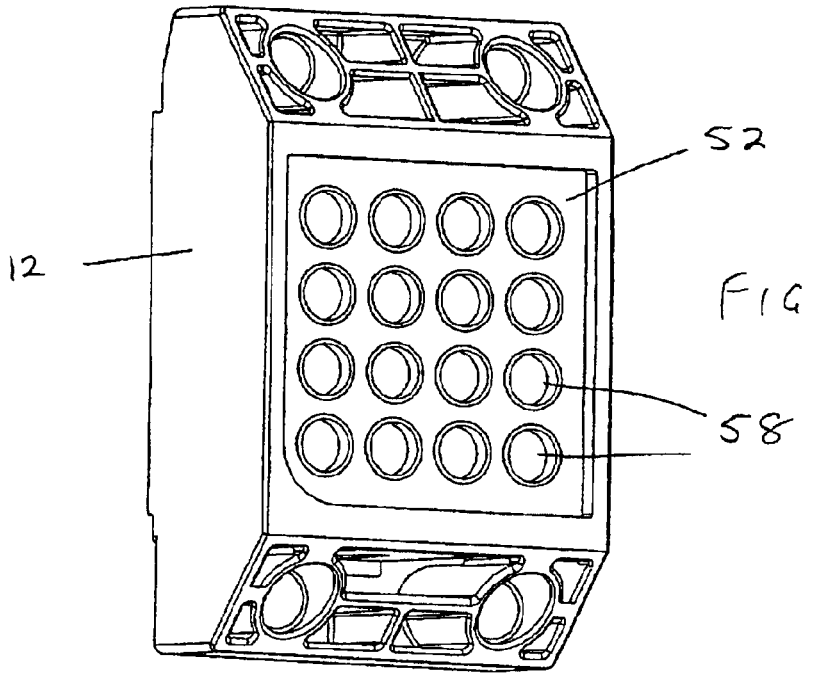
FIG. 9 is an isometric view of the top of the snap mount relay socket shown in FIG. 6.

A four connector arrangement is shown in FIGS. 8 and 9 in which similar reference numbers are used as in the prior figures. Note however, that in this arrangement the heel 84 is located between the openings 32 and there is no longer a need to have the cutout 36 in the heel 14.

Figure 11:
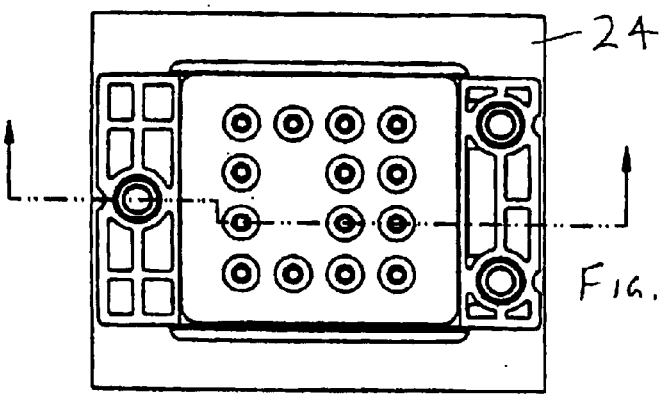
FIG. 11 is a top view of the assembly shown in FIG. 1.
Figure 12:
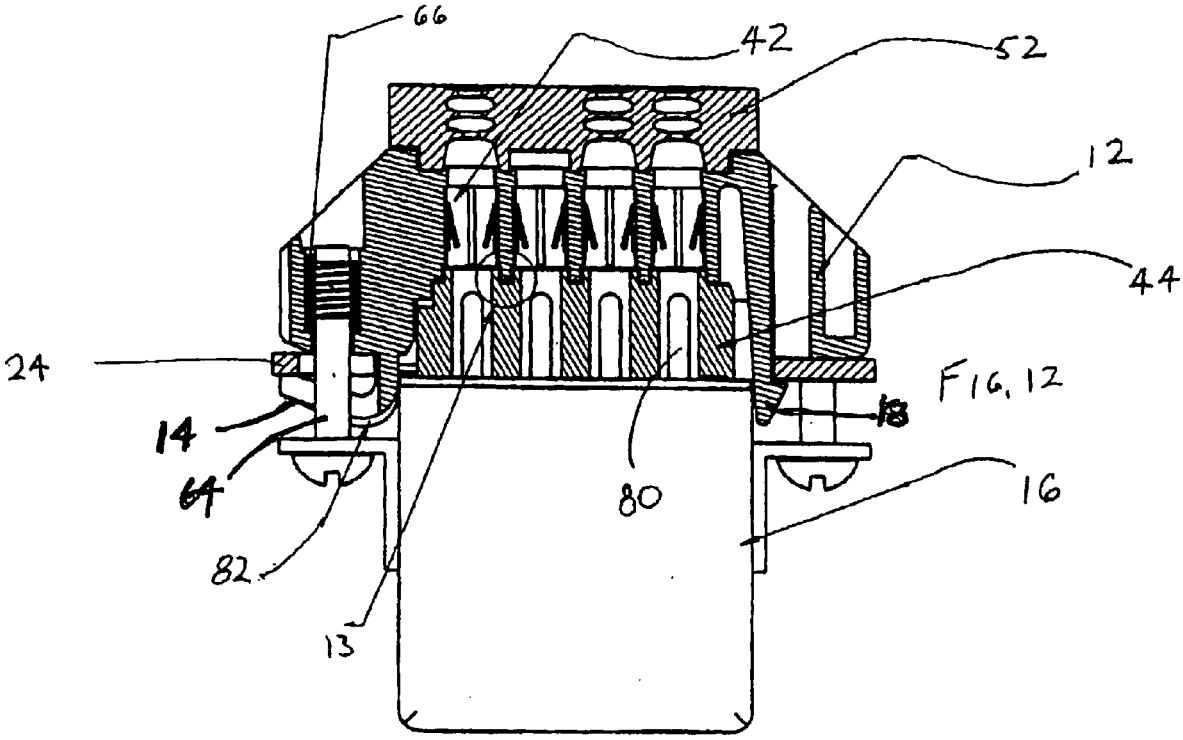
FIG. 12 is a partial vertical sectional view of the relay-socket assembly, the section being taken along the plane defined by reference line A—A of FIG. 11B.
Figure 13:
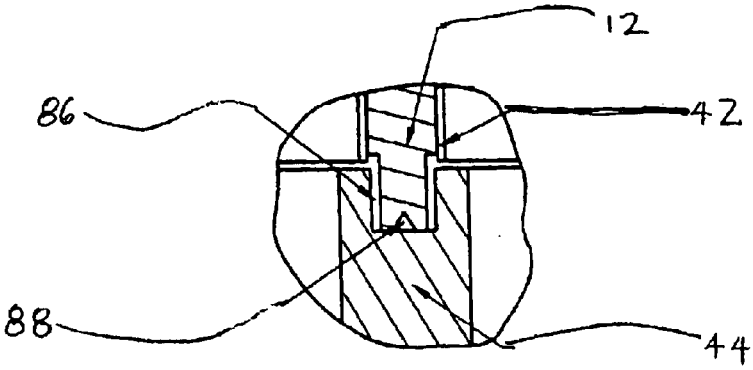
FIG. 13 shows details of area C of FIG. 12.

FIGS. 11, 12 and 13 show some further details of the assembly, with certain parts omitted for clarity. FIG. 11 is a plan view of the socket shown in FIG. 1. FIG. 12 is a partial cross sectional view taken generally along reference line 12-12 in FIG. 11, with some support bosses and the spacers not shown for clarity. Thus, the socket 10 is first fixed to the mounting panel 24 as explained in connection with FIG. 5. then the relay is connected as explained in connection with FIG. 4. The grommet 52 can be seen with its openings 58 into which leads to a circuit can be placed. These leads will contact and be spring engaged by the retainer clips 42. the relay 16 has leads 80 which project into openings in the bottom housing 44 and are engaged by contact surfaces (not shown) which provide an electrical connection to the retainer clips and thus to the leads in the grommet openings. There is a strengthening rib as shown in FIG. 12.

FIG. 13 is a detail in cross section taken as an enlargement of the reference circle 13 in FIG. 12. This shows the top housing 12, retaining clip 42, bottom housing 44 as well as a flash relief 86 and an energy director 88.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A relay socket attachable to a cutout in a panel, comprising:

a base;

at least one rocker beam element at one side of said base, said rocker beam element being curved to fit the edge of the cutout and curved downwardly in a direction outwardly from the base;

at least one active snap element at the opposite side of said base, the snap element being at least partially flexible and having an outwardly facing shoulder near its end;

said elements extending from the bottom of the base and being constructed and arranged so that the socket may be inserted into place by engaging the rocker beam element on one side of a cutout in a panel and pivoting the active snap element toward the opposite side of the cutout so that it engages the opposite side of the cutout and moves inwardly and is inserted into said cutout in which position it moves outwardly to engage the opposite side of the cutout and the elements cooperatively hold the socket onto the panel; and wherein there is a U-shaped opening in the rocker element to form two such elements and to provide space for a relay mounting screw.

2. A socket as defined in claim 1 wherein there are two snap elements to provide space between them for a relay mounting screw.

3. A relay assembly, comprising:

a panel with a cutout into which a relay socket is to be attached;

a relay socket including:

(i). a base having an upper side and a lower side, (ii). at least one rocker beam element at one end of said base and at the lower side of said base, wherein the rocker beam element is curved to fit the panel, is curved to fit the edge of the cutout, and is curved downwardly and extends in a direction outwardly from the base, (iii). at least one active snap element at an opposite end of said base and at the lower side of said base, the snap element being at least partially flexible and having an outwardly facing shoulder near its end, (iv). said elements extending from the bottom of the base and being constructed and arranged so that the socket may be inserted into place by engaging the rocker beam element on one side of the cutout in the panel and pivoting the active snap element toward the opposite side of the cutout so that the snap element engages the opposite side of the cutout and moves inwardly and be inserted into said cutout in which position the snap element moves outwardly to engage the opposite sides of the cutout and hold the socket onto the panel; and a relay attached to the upper side of the relay socket and on the opposite side of the panel from the socket; and wherein there is a U-shaped opening in the rocker element to form two such elements and to provide space for a relay mounting screw.

4. A relay assembly, comprising:

a panel with a cutout into which a relay socket is to be attached;

a relay socket including:

(i). a base having an upper side and a lower side, (ii). at least one rocker beam element at one end of said base and at the lower side of said base, wherein the rocker beam element is curved to fit the panel, is curved to fit the edge of the cutout, and is curved downwardly and extends in a direction outwardly from the base, (iii). at least one active snap element at an opposite end of said base and at the lower side of said base, the snap element being at least partially flexible and having an outwardly facing shoulder near its end, (iv). said elements extending from the bottom of the base and being constructed and arranged so that the socket may be inserted into place by engaging the rocker beam element on one side of the cutout in the panel and pivoting the active snap element toward the opposite side of the cutout so that the snap element engages the opposite side of the cutout and moves inwardly and be inserted into said cutout in which position the snap element moves outwardly to engage the opposite sides of the cutout and hold the socket onto the panel; and a relay attached to the upper side of the relay socket and on the opposite side of the panel from the socket; and wherein there are two snap elements to provide space between them for a relay mounting screw.

* * * * *